US011730218B2

(12) United States Patent
Kwo

(10) Patent No.: US 11,730,218 B2
(45) Date of Patent: Aug. 22, 2023

(54) HYBRID MULTI-PLATE MAT SHIRT FOLDING APPARATUS AND METHODS OF USE

(71) Applicant: LK Studio, Inc., Sierra Madre, CA (US)

(72) Inventor: So Kwo, Sierra Madre, CA (US)

( * ) Notice: Subject to any disclaimer, the term of this patent is extended or adjusted under 35 U.S.C. 154(b) by 169 days.

(21) Appl. No.: 17/473,305

(22) Filed: Sep. 13, 2021

(65) Prior Publication Data

US 2023/0083185 A1 Mar. 16, 2023

(51) Int. Cl.
*A41H 43/02* (2006.01)

(52) U.S. Cl.
CPC ..... *A41H 43/0257* (2013.01)

(58) Field of Classification Search
CPC ... A41H 43/0257; D06F 89/02; D06F 89/005; D06F 89/023
See application file for complete search history.

(56) References Cited

U.S. PATENT DOCUMENTS 5,011,052 A * 4/1991 Craig ..... D06F 89/023 223/37
6,360,927 B1 * 3/2002 Barker ..... D06F 89/02 223/37
6,814,269 B1 * 11/2004 Fernandez ..... D06F 89/005 223/37
9,022,259 B2 * 5/2015 Breier ..... D06F 89/023 223/38
11,060,238 B1 * 7/2021 Cruz ..... D06F 89/02
2008/0264983 A1 * 10/2008 Kastan ..... D06F 89/005 223/37

* cited by examiner

*Primary Examiner* — F Griffin Hall
(74) *Attorney, Agent, or Firm* — Metropolis IP Group, LLC; Eric Kang

(57) ABSTRACT

A shirt folding apparatus, comprising a substantially rectangular upper mat, a substantially rectangular lower mat, a plurality of substantially rectangular plates, said plates are arranged in three columns each with three plates and three rows each with three plates, wherein the three columns are a Western Column, Center Column, and Eastern Column, wherein the three rows are a Northern Row, Center Row, and Southern Row, wherein the total surface area of said plates is much less than the surface area of either the upper or lower mats such that when laid out in rows and columns, a gap exists between the plates where the shirt folding apparatus can be folded, wherein said plurality of plates is laminated between said upper and lower mats using an adhesive, wherein said shirt folding apparatus is bounded by four edges that includes a Northern Edge, Eastern Edge, Southern Edge, and Western Edge, a plurality of grid elements, wherein a grid element is approximated by the local region of said shirt folding apparatus fully containing the nearest plate.

11 Claims, 6 Drawing Sheets

200

HYBRID MULTI-PLATE MAT SHIRT FOLDING APPARATUS AND METHODS OF USE

BACKGROUND OF THE INVENTION

1. Field of the Invention

The invention relates to a shirt folding apparatus and methods of use.

2. Discussion of the State of the Art

Currently known devices for folding shirts are lacking in several ways. For example, the folding board of Shaalan (U.S. Pat. No. 5,947,349) fold shirts into a dimension that would not fit in the drawers of standard dressers when stacked sideways like shelved books in a bookcase. This is because these types of devices generally cater to retail storefronts that stack folded shirts flat on a shelf. Such stacking in a dresser makes it difficult to see what shirts lie below the shirt facing the user. In addition, Shaalan's folding board cannot itself be folded into a more compact storable form.

The most common shirt folding devices found on online retailers are the types by GENIUSIDEA or BOXLEGEND, also suffer from the same limitation of a large resultant folded shirt footprint. These devices also are typically constructed of a plurality of smooth plastic panels with holes to reduce mass and weight, but a smooth surface with less surface area also translates to potentially less grip to hold the shirt in place while the shirt is being folded. This may result in a more wrinkled fold unless the panels are turned rapidly by the user during shirt folding. The adjoining panels of these devices are generally linked by a plurality of molded hinges integrated with said panels that appear prone to breakage if a heavy weight is placed on them on a soft cushiony surface like a bed or in luggage handled roughly.

Another device, by Huang (U.S. Pat. No. 4,889,264), is very complicated, intricate, and bulky. Finally, all the previously mentioned shirt folding devices are generally not intuitive for a first-time user to use.

SUMMARY OF THE INVENTION

The present disclosure is drawn to a novel shirt folding apparatus—a Hybrid Multi-Plate Mat Shirt Folding Apparatus (HMPSFA)—that addresses all previously mentioned vices in current folding shirt devices with a radically different yet elegantly simple, rugged, and lightweight construction and design. Any of the preferred embodiments of the HMPSFA comprises a plurality of plates spaced apart from each other in columns and rows and laminated together by felt mats. The gaps between the plates where just the upper and lower mats exist are natural folding hinges that are rugged and do not have the prominent stress concentration factors that the current hinged folding board designs have. The shirts folded by the HMPSFA can be stacked sideways in a standard-sized dresser drawer as opposed to one on top of each other such that it is subsequently easy to pick out a certain shirt from the others in the dresser in a similar manner as easily identifying and selecting a book by looking at its spine from a bookshelf.

None of the current designs can be collapsed to as compact a form as the HMPSFA can because every inter-plate gap is a hinge without any folding range of motion restrictions, meaning one portion the HMPSFA can be folded up to 360° about another portion of the HMPSFA in any direction to support "accordion" folds. This in turn enables any of the preferred embodiments of the HMPSFA to be able fold to approximately the same physical footprint as its folded shirts and fits in a standard-sized dresser drawer alongside its folded shirts for convenient storage.

The fibrous surface topology of the felt mats intertwines with the fibers of a shirt to grip the shirt better than any current folding board could so that the fold is as wrinkle-free as possible. The HMPSFA features heat embossed "infographics" that help even first-time users be successful.

The design and dimensions of the HMPSFA allow the folded shirts to be stacked sideways in the drawers of typical dressers so that it is easy to pick out the desired shirt. Two embodiments of the HMPSFA—one for adult-sized shirts and one for infant-sized shirts—are disclosed and have different mat aspect ratios and plate dimensions.

BRIEF DESCRIPTION OF THE DRAWING FIGURES

The drawings are provided to facilitate understanding in the detailed description. It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION

Figure 1:
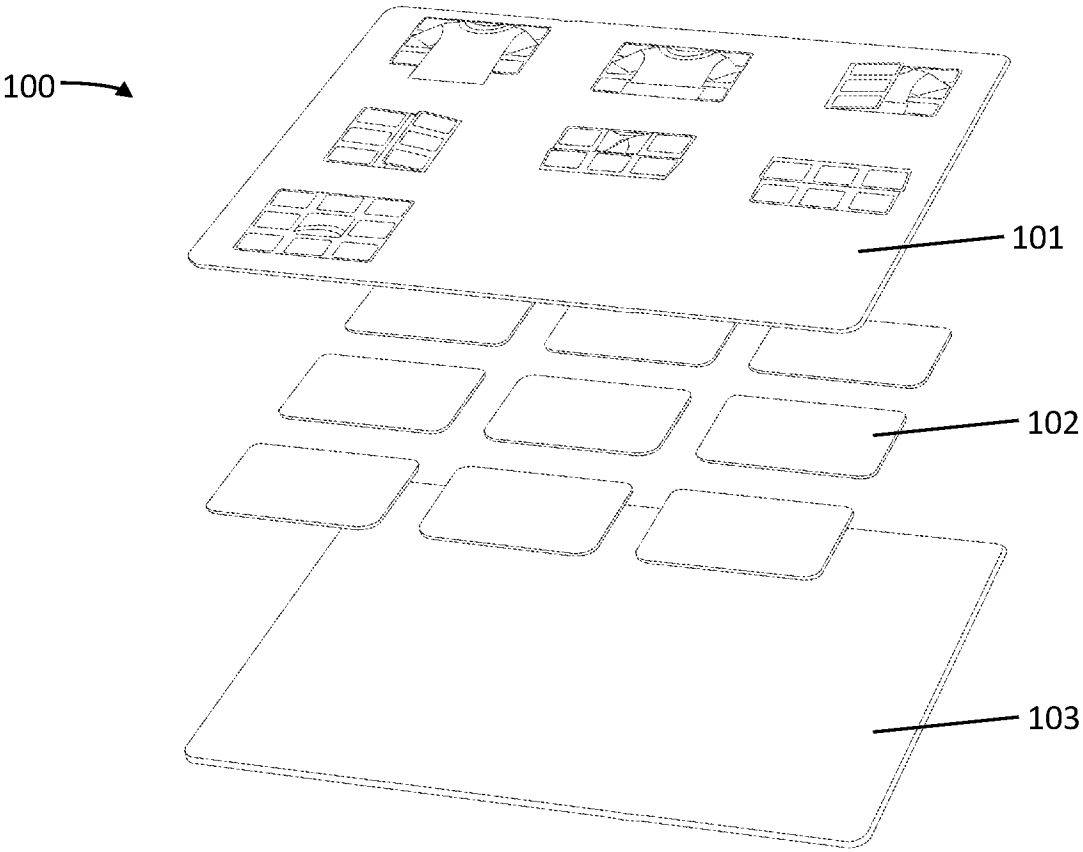
FIG. 1 is an exploded parts view of the adult embodiment of the Hybrid Multi-Plate Mat Shirt Folding Apparatus (HMPSFA)

MAIN COMPONENTS AND CONSTRUCTION OF THE HMPSFA (Ref. FIG. 1): FIG. 1 shows an exploded parts view of the adult embodiment (100) of the Hybrid Multi-Plate Mat Shirt Folding Apparatus (HMPSFA), which comprises of a substantially rectangular upper mat (101), a plurality of substantially rectangular thin but hard plates (102), and a substantially rectangular lower mat (103). The corners of the mats (101 and 103) as well as the plates (102) may be rounded of radiused, so the corners are not sharp. The preferred material embodiment of the upper and lower mats (101 and 103, respectively) is wool felt, wherein the preferred composition is 20% wool and 80% rayon or materials with similar properties including the ability to be heat embossed with line patterns. The fibrous surface topology of the preferred mat materials may intertwine with the fibers of the shirt being folded to offer better grip while the shirt is being folded and enable a potentially more wrinkle-free fold. The plates (102) are preferably made from cut bamboo or cut or molded plastic sheets but can also be made of any material that exhibit similar properties of high rigidity to mass ratio, durability, and machinability or moldability.

Embodiments of the present invention can have the upper mat's (101) outward facing surface with a plurality of "infographics" or pictorial imprints that guide users with the recommended step-by-step method to use the HMPSFA. These imprints can be created by heat embossing the upper mat's (101) outward facing surface with the pictorial elements. The preferred placement embodiment of the infographics is above and within the area where the plates (102) would reside underneath the upper mat (101). Compared to painted on pictorial elements that can fade or rub off over time, this type of imprinting is more durable.

The total surface area of the plates (102) is much less than the surface area of either the upper (101) or lower (103) mats such that when laid out in rows and columns as shown in FIG. 1, that a notable gap exists between the plates (102) and thereby enable the HMPSFA's to compactly fold shirts or itself.

The HMPSFA is assembled by laminating the plates (102) in between the inward facing surfaces of the upper and lower mats (101 and 103, respectively) with any adhesive that can withstand repeated cycles of folding without degradation. Therefore, the outward facing surfaces of the upper and lower mats (101 and 103, respectively) are on the opposite side of the inward facing surfaces of the upper and lower mats (101 and 103, respectively).

Figure 2:
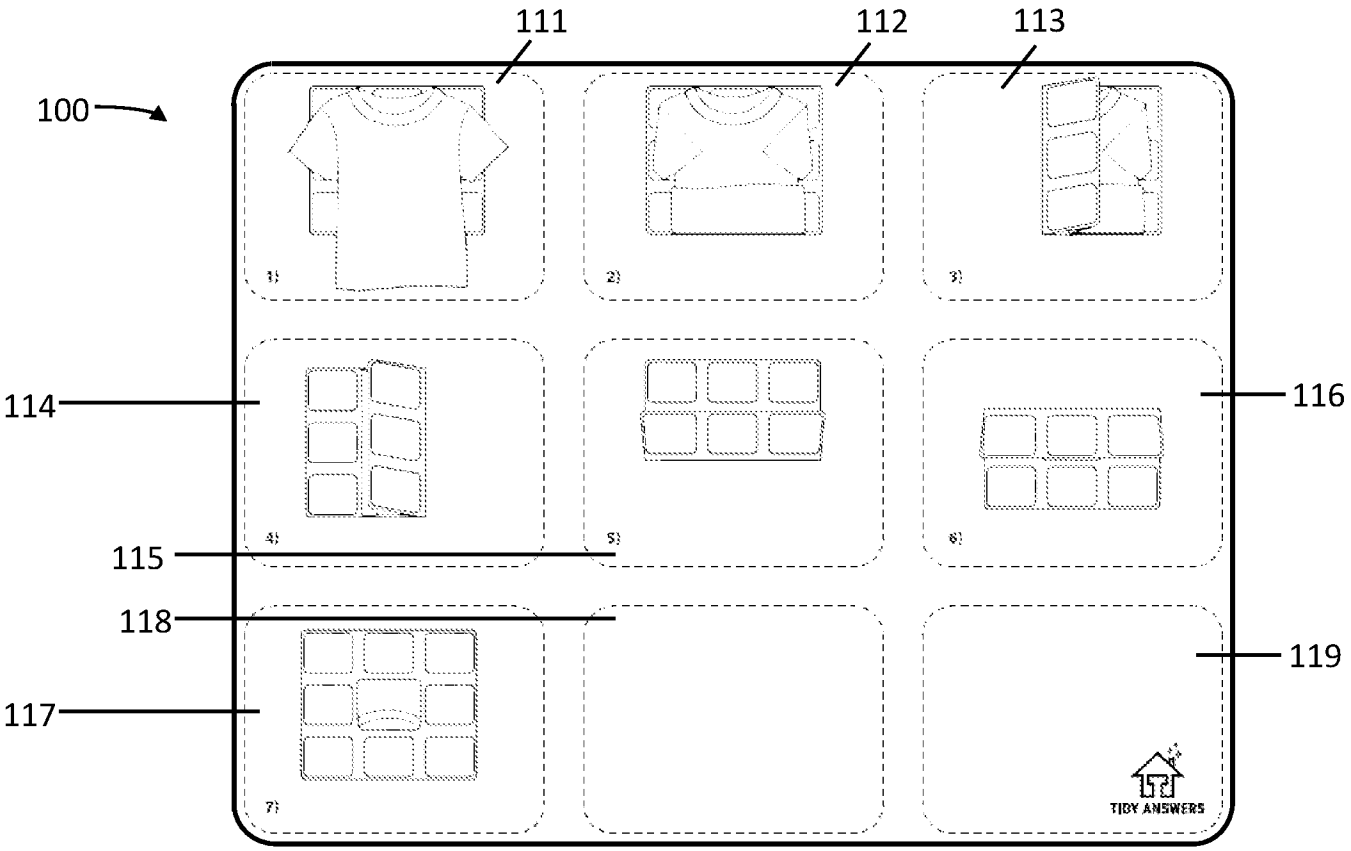
FIG. 2 is a top view of the adult embodiment of the HMPSFA

PLATE LAYOUT AND SECTION NOMENCLATURE OF THE ADULT EMBODIMENT OF THE HMPSFA (Ref. FIG. 2): FIG. 2 shows the top view of the adult embodiment (100) of the HMPSFA. The location of the plates (102) under the upper mat (101) is indicated by the dashed lines outlining each plate (102). In any of the preferred embodiments of the present invention, the plates (102) are arranged in a grid-like manner of three rows and three columns, but the scope of the invention need not be limited to this number of rows and columns nor have exactly nine plates.

The upper (101) and lower (103) mats of the adult embodiment (100) of the HMPSFA are preferably dimensioned to be approximately 68.3 cm wide by 53.3 cm tall. This establishes a preferred mat (101 and 103) width to height aspect ratio of approximately 1.28. The preferred inter-plate separation is approximately 2.7 cm.

Each of the plates (102) of the adult embodiment (100) of the HMPSFA is preferably approximately 20.5 cm wide by 15.5 cm tall. This establishes a preferred plate width to height aspect ratio of approximately 1.32.

To make subsequent explanation as succinct as possible, the local grid element regions of the HMPSFA shall be referred to as Northwest (NW), North (N), Northeast (NE), West (W), Central (C), East (E), Southwest (SW), South (S), and Southeast (SE) enumerated 111, 112, 113, 114, 115, 116, 117, 118, and 119, respectively. The area extent of each of these grid elements are approximated by the dashed lines of where each plate (102) would reside within the HMPSFA. For any of the preferred embodiments of the HMPSFA, the multiple—preferably three—inline grid elements are arranged in rows and columns, which are labelled as follows:

Northern Row ("NR"): 111, 112, and 113
Center Row ("CR"): 114, 115, and 116
Southern Row ("SR"): 117, 118, and 119
Western Column ("WC"): 111, 114, and 117
Center Column ("CC"): 112, 115, and 118
Eastern Column ("EC"): 113, 116, and 119

Each of the plates (102) lying within their respective grid elements 111, 112, 113, 114, 116, 117, 118, and 119 have at least one outward facing edge near the outer edge of the mats (101 and 103). The distance of this "lip" between each of these outward facing edges of said plates (102) and the outer edge of the mats (101 and 103) is preferably around 0.7 cm.

Any of the preferred embodiments of the HMPSFA depicts the infographics sequentially outlining the folding steps in the same order the grid elements (111-117 as shown) are numbered. Step numbers can be optionally heat embossed onto the outward facing surface of the upper mat (101) within each of the grid elements with infographics to emphasize the proper sequence.

Figure 3:
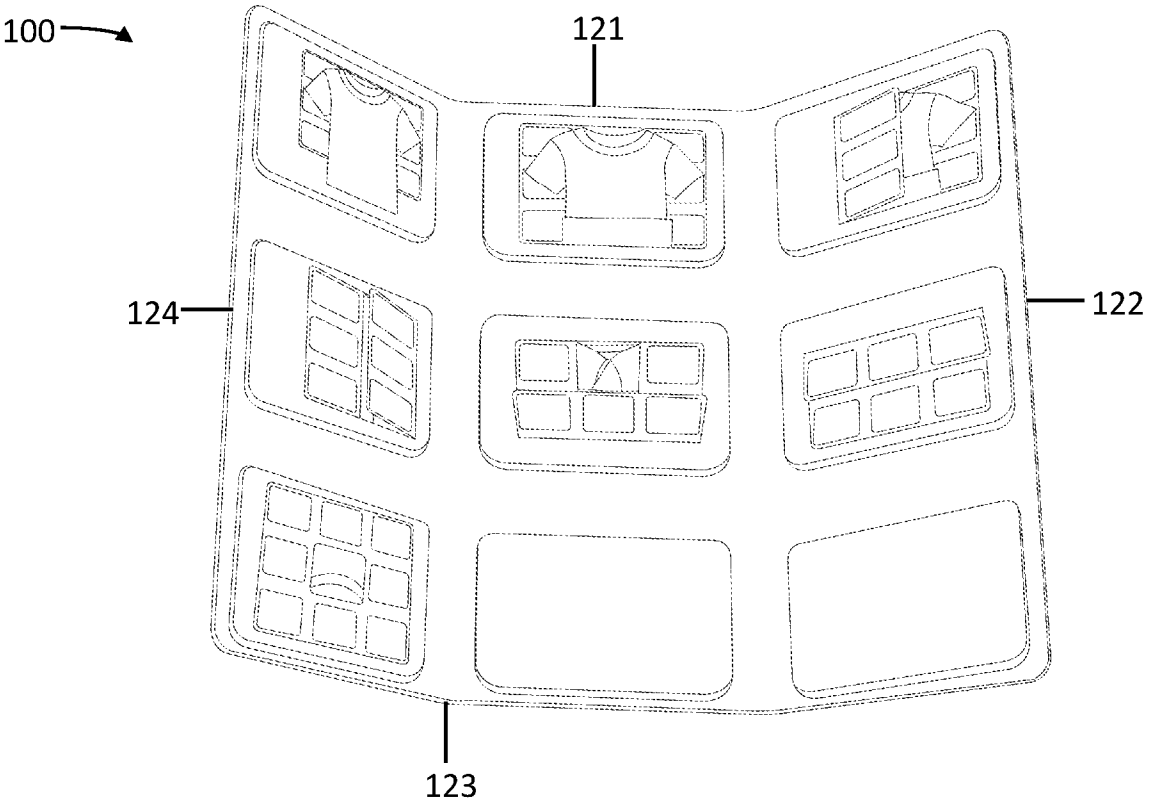
FIG. 3 is a top view of the adult embodiment of the HMPSFA showing the Eastern and Western Column portions partially folded

OVERALL VIEW AND EDGE NOMENCLATURE OF THE ASSEMBLED HMPSFA (Ref. FIG. 3): FIG. 3 shows the top view of the adult embodiment (100) of the HMPSFA showing the Eastern and Western Column (EC and WC, respectively) portions partially folded inward toward the Center Column (CC) portion of the upper mat (100). To facilitate future explanation, the HMPSFA is bounded by four edges termed as follows:

Northern Edge (121)
Eastern Edge (122)
Southern Edge (123)
Western Edge (124)

Therefore, the folding shown in FIG. 3 is accomplished by lifting the Eastern and Western Edges (122 and 124, respectively) above or while the Northern and Southern Edge (121 and 123, respectively) are flat against a surface under the HMPSFA.

Figure 4:
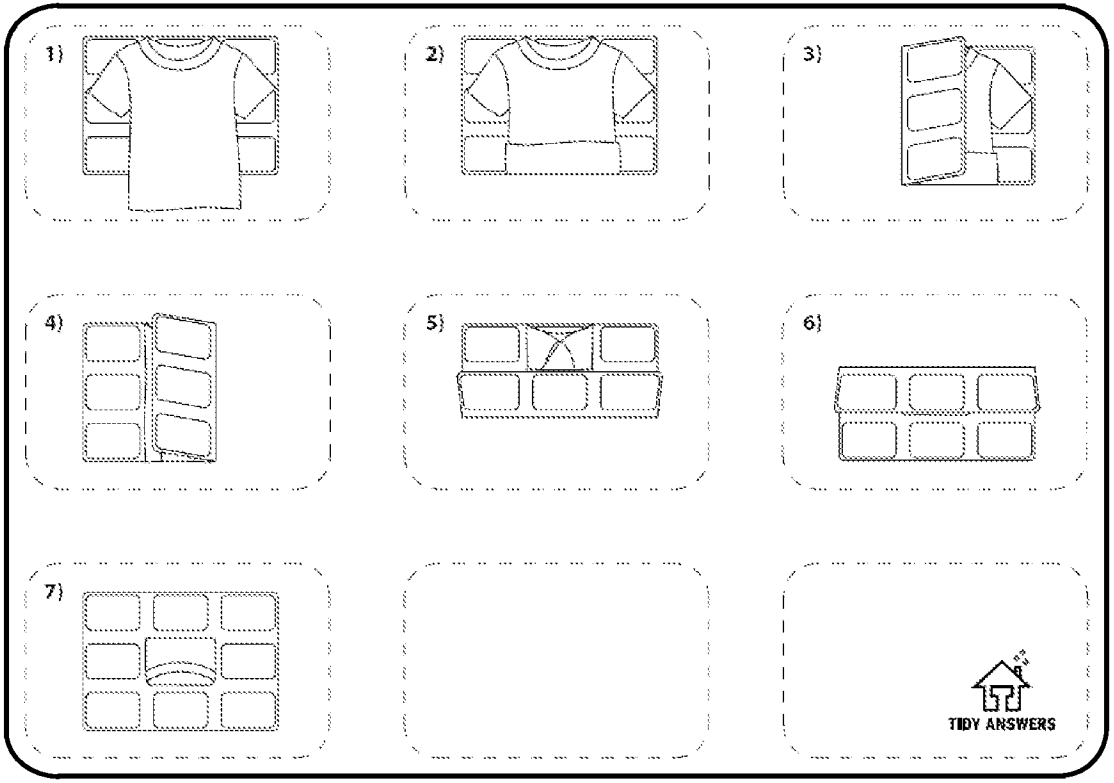
FIG. 4 is a top view of the infant embodiment of the HMPSFA

THE INFANT EMBODIMENT OF THE HMPSFA (Ref. FIG. 4): FIG. 4 shows the infant embodiment (200) of the HMPSFA. The materials, construction, and elements (upper mat, lower mat, plurality of plates, infographics) are identical to the adult embodiment (100). The infant embodiment's (200) preferred inter-plate spacing and lip offset of approximately 2.7 cm and 0.7 cm, respectively, is also carried over from the adult embodiment (100). The upper and lower mats of the infant embodiment (200) are preferably dimensioned to be approximately 39.8 cm wide by 27.8 cm tall. This establishes a preferred infant embodiment (200) mat width to height aspect ratio of approximately 1.43, making it more rectangular and less square than the adult embodiment (100). Each of the plates of the child embodiment (200) is preferably approximately 11.0 cm wide by 7.0 cm tall. This establishes a preferred plate width to height aspect ratio of approximately 1.57, which is a higher aspect ratio than that of the plates (102) used for the adult embodiment (100).

Figure 5:
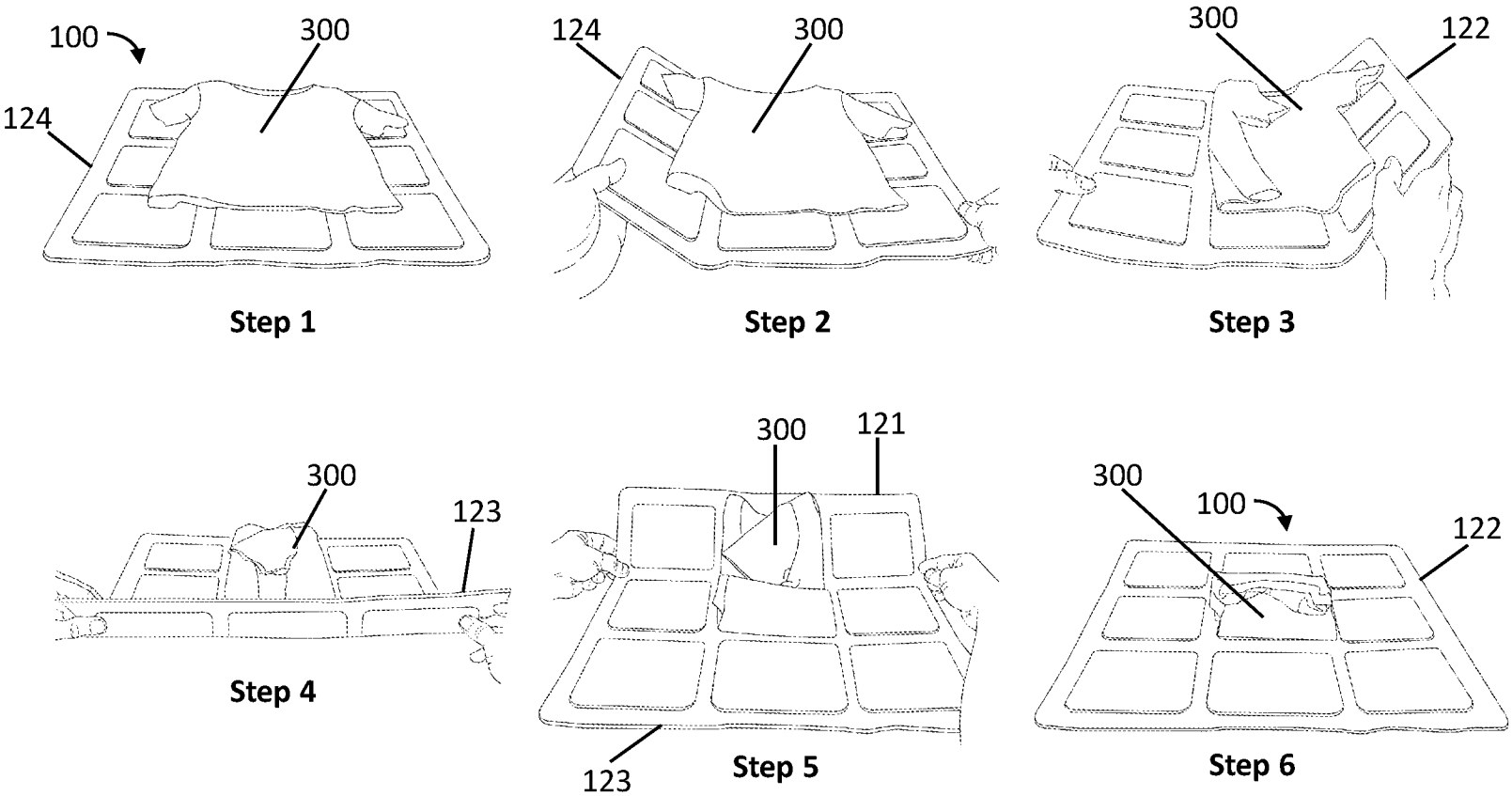
FIG. 5 illustrates the steps to fold shirts using the HMPSFA

METHOD OF FOLDING SHIRTS WITH THE HMPSFA (Ref. FIG. 5): FIG. 5 illustrates the preferred steps to fold shirts using the adult embodiment (100) of the HMPSFA, but the method as applied to the infant embodiment (200) is identical. The steps are as follows:

Step 1: Lay the HMPSFA in its most expanded or unfolded form with its lower mat (103) on a surface like a tabletop or top of a bed. The Western Edge (124) is outward facing to the left. Lay the back of the shirt (300) to be folded on top of the outward facing surface of the upper mat (101) with its top-most portion closest to the Northern Edge (121).

Step 2: Lift the Western Edge (124) and fold the HMPSFA such that the outward facing surface of the upper mat (101) of the WC is folded onto the outward facing surface of the upper mat (101) of the CC. Another hand may be needed to hold the HMPSFA in place during this process. Afterwards, unfold the Western Edge (124) and WC back to the same unfolded state in Step 1 so that the HMPSFA is flat again, leaving the "western" side of the shirt folded toward its center.

Step 3: Lift the Eastern Edge (122) and fold the HMPSFA such that the outward facing surface of the upper mat (101) of the EC is folded onto the outward facing surface of the upper mat (101) of the CC. Another hand may be needed to hold the HMPSFA in place during this process. Afterwards, unfold the Eastern Edge (122) and EC back to the same unfolded state in Step 1 so that the HMPSFA is flat again, leaving the "eastern" side of the shirt folded toward its center.

Step 4: Lift the Southern Edge (123) and fold the HMPSFA such that the outward facing surface of the upper mat (101) of the SR is folded onto the outward facing surface of the upper mat (101) of the CR. Afterwards, unfold the Southern Edge (123) and SR back to the same unfolded state in Step 1 so that the HMPSFA is flat again, leaving the "southern" side of the shirt folded toward its center.

Step 5: Lift the Northern Edge (121) and fold the HMPSFA such that the outward facing surface of the upper mat (101) of the NR is folded onto the outward facing surface of the upper mat (101) of the CR. Afterwards, unfold the Northern Edge (121) and NR back to the same unfolded state in Step 1 so that the HMPSFA is flat again, leaving the "northern" side of the shirt folded toward its center.

Step 6: The compactly folded shirt is shown ready to be removed from the HMPSFA.

Alternative shirt folding method embodiments of the present invention include the scope that the order of Steps 2 and 3 can be reversed and the order of Steps 4 and 5 can be reversed as well.

Figure 6:
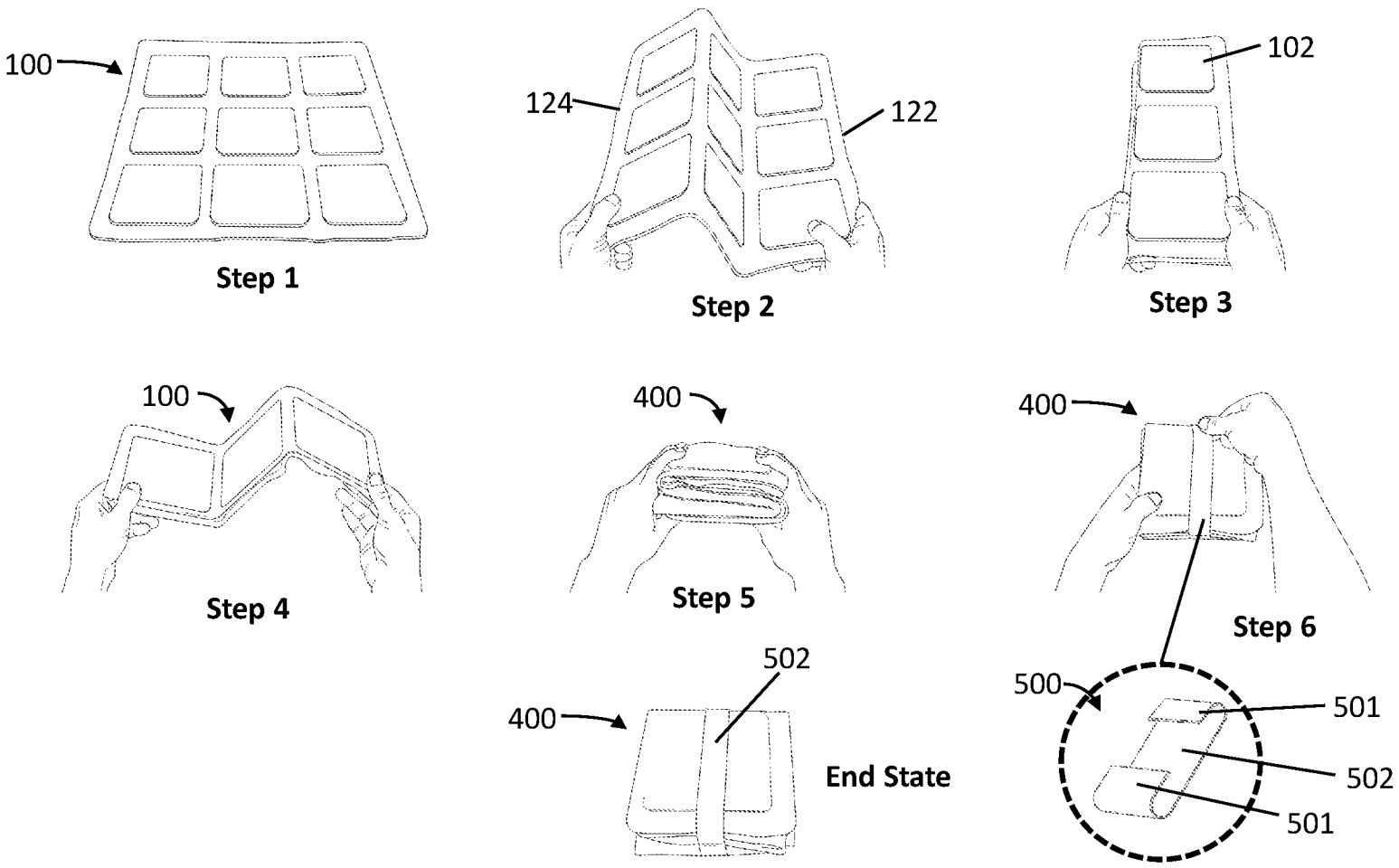
FIG. 6 illustrates the steps to fold the HMPSFA and maintain the HMPSFA to its most compact form

METHOD OF FOLDING THE HMPSFA FOR STORAGE (Ref. FIG. 6): FIG. 6 illustrates the steps to fold the adult embodiment (100) of the HMPSFA and maintain the HMPSFA to its most compact form for storage alongside the folded clothes in the dresser drawer. This method identically applies for the infant embodiment (200). The steps are as follows:

Step 1: Start with the HMPSFA open and flat as shown.

Step 2: One embodiment of this step is to fold the HMPSFA such that the outward facing surface of the upper mat (101) of the CC folds on top of the outward facing surface of the upper mat (101) of the EC as shown. At the same time, the HMPSFA is folded such that the outward facing surface of the lower mat (103) of the WC folds onto the outward facing surface of the lower mat (103) of the CC as shown. If these two folding operations are done simultaneously as shown, the fold along the Southern and Northern Edges resemble a "Z" like pattern like the first step of folding a large, printed map, which is commonly termed an "accordion" fold.

An alternative embodiment of Step 2 is where the outward facing surface of the upper mat (101) of the CC folds on top of the outward facing surface of the upper mat (101) of the WC and the outward facing surface of the lower mat (103) of the EC folds onto the outward facing surface of the lower mat (103) of the CC. This is not shown but equivalent.

Another alternative embodiment of Step 2 is where the outward facing surface of the upper mat (101) of the CR folds on top of the outward facing surface of the upper mat (101) of the NR and the outward facing surface of the lower mat (103) of the SR folds onto the outward facing surface of the lower mat (103) of the CR. This is not shown but equivalent.

Another alternative embodiment of Step 2 is where the outward facing surface of the upper mat (101) of the CR folds on top of the outward facing surface of the upper mat (101) of the SR and the outward facing surface of the lower mat (103) of the NR folds onto the outward facing surface of the lower mat (103) of the CR. This is not shown but equivalent.

The common aspect of all the embodiments in Step 2 here is the HMPSFA is folded about the CR or CC in an accordion fold, which is a fully enabling characterization of the above detailed steps.

Step 3: Lay the accordion folded HMPSFA such that there is a single column or row of grid elements in line. For any of the preferred embodiments of the HMPSFA, there are three visible grid elements stacked in three layers.

Step 4: Perform another accordion fold for the remaining three grid element into a single stack of grid elements, which in any of the preferred embodiments of the HMPSFA, would be a single stack of nine grid elements (111-119).

Step 5: Continue the second accordion fold until the HMPSFA is in its fully folded or compacted form (400).

Step 6: While holding the HMPSFA (400) in its fully folded form, place an open-ended cuff (500), where the cuff's distally-located "C-shaped" ends (501) are placed around the opposing ends of the compacted HMPSFA (400). Then the main body or spine (502) of the cuff (500) is displaced to approximately the proximal or lateral center of the compacted HMPSFA (400) as shown in the "End State" diagram. Note, other viable alternative embodiments to the open-ended cuff can comprise an elastic band, clip, or VELCRO® band.

Many alterations and modifications may be made by those having ordinary skill in the art without departing from the spirit and scope of the embodiment. Therefore, it must be understood that the illustrated embodiment has been set forth only for the purposes of example and that it should not be taken as limiting the embodiment.

The words used in this specification to describe the embodiment and its various embodiments are to be understood not only in the sense of their commonly defined meanings, but to include by special definition in this specification structure, material or acts beyond the scope of the commonly defined meanings.

VELCRO® is a registered trademark of Velcro BVBA.

What is claimed is:

1. A shirt folding apparatus, comprising:

a substantially rectangular upper mat;

a substantially rectangular lower mat;

a plurality of substantially rectangular plates;

said plates are arranged in three columns each with three plates and three rows each with three plates;

wherein the three columns are a western column, center column, and eastern column, wherein the three rows are a northern row, center row, and southern row;

wherein the total surface area of said plates is much less than the surface area of either the upper or lower mats such that when laid out in rows and columns, a gap exists between the plates where the shirt folding apparatus can be folded;

wherein said plurality of plates is laminated between said upper and lower mats using an adhesive;

wherein said shirt folding apparatus is bounded by four edges that include a northern edge, eastern edge, southern edge, and western edge;

a plurality of grid elements;

wherein a grid element is approximated by the local region of said shirt folding apparatus fully containing the nearest plate.

2. The shirt folding apparatus of claim 1, wherein said upper and lower mats are made from a material with fibrous surface topology.

3. The shirt folding apparatus of claim 1, wherein the upper mat's outward-facing surface has a plurality of pictorial imprints that guide users on the suggested steps for folding shirts with the shirt folding apparatus.

4. The shirt folding apparatus of claim 3, wherein said plurality of pictorial imprints is created by heat embossing the upper mat's outward-facing surface with said pictorial elements.

5. The shirt folding apparatus of claim 1, wherein said upper and lower mats of an adult embodiment are approximately 68.3 cm wide by 53.3 cm tall, with an inter-plate separation of approximately 2.7 cm, and each plate dimension of approximately 20.5 cm wide by 15.5 cm tall.

6. The shirt folding apparatus of claim 1, wherein said upper and lower mats of an infant-sized embodiment are approximately 39.8 cm wide by 27.8 cm tall, with an inter-plate separation of approximately 2.7 cm, and each plate dimension of approximately 11.0 cm wide by 7.0 cm tall.

7. A method of folding shirts using a shirt folding apparatus, the apparatus comprising a substantially rectangular upper mat, a substantially rectangular lower mat, a plurality of substantially rectangular plates, said plates are arranged in three columns each with three plates and three rows each with three plates, wherein the three columns are a western column, center column, and eastern column, wherein the three rows are a northern row, center row, and southern row, wherein the total surface area of said plates is much less than the surface area of either the upper or lower mats such that when laid out in rows and columns, a gap exists between the plates where the shirt folding apparatus can be folded, wherein said plurality of plates is laminated between said upper and lower mats using an adhesive, wherein said shirt folding apparatus is bounded by four edges that includes a northern edge, eastern edge, southern edge, and western edge, a plurality of grid elements, wherein a grid element is approximated by the local region of said shirt folding apparatus fully containing the nearest plate, whereby the shirt folding comprises the steps:

A) laying the completely unfolded shirt folding apparatus with said lower mat on a surface, wherein the western edge of said shirt folding apparatus is outward-facing to the left and the back of the shirt to be folded is on top of the outward-facing surface of said upper mat with its top-most portion closest to the northern edge of the shirt folding apparatus;

B) lifting said western edge and folding the shirt folding apparatus such that the outward-facing surface of the upper mat of the western column of said shirt folding apparatus is folded onto the outward-facing surface of the upper mat of the center column of said shirt folding apparatus, followed by unfolding said western edge and western column back to the same state as in Step A so that the shirt folding apparatus is flat again, thereby leaving the "western" side of the shirt folded toward its center;

C) lifting the eastern edge of the shirt folding apparatus and folding the shirt folding apparatus such that the outward-facing surface of the upper mat of the eastern column of said shirt folding apparatus is folded onto the outward-facing surface of the upper mat of said center column, followed by unfolding said eastern edge and western column back to the same state as in Step A so that the shirt folding apparatus is flat again, leaving the "eastern" side of the shirt folded toward its center;

D) lifting the southern edge of the shirt folding apparatus and folding the shirt folding apparatus such that the outward-facing surface of the upper mat of the southern row of said shirt folding apparatus is folded onto the outward-facing surface of the upper mat of the center row of said shirt folding apparatus, followed by unfolding said southern edge and southern row back to the same state as in Step A so that the shirt folding apparatus is flat again, leaving the "southern" side of the shirt folded toward its center; and E) lifting the northern edge and folding the shirt folding apparatus such that the outward-facing surface of the upper mat of the northern row of said shirt folding apparatus is folded onto the outward-facing surface of the upper mat of said center row, followed by unfolding said northern edge and northern row back to the same state as in Step A so that the shirt folding apparatus is flat again, leaving the "northern" side of the shirt folded toward its center.

8. The method of folding shirts using a shirt folding apparatus according to claim 7, wherein the order of Steps B and C can be reversed.

9. The method of folding shirts using a shirt folding apparatus according to claim 7, wherein the order of Steps D and E can be reversed.

10. A method of collapsing a shirt folding apparatus into its most compact form, the apparatus comprising a substantially rectangular upper mat, a substantially rectangular lower mat, a plurality of substantially rectangular plates, said plates are arranged in three columns each with three plates and three rows each with three plates, wherein the three columns are a western column, center column, and eastern column, wherein the three rows are a northern row, center row, and southern row, wherein the total surface area of said plates is much less than the surface area of either the upper or lower mats such that when laid out in rows and columns, a gap exists between the plates where the shirt folding apparatus can be folded, wherein said plurality of plates is laminated between said upper and lower mats using an adhesive, wherein said shirt folding apparatus is bounded by four edges that include a northern edge, eastern edge, southern edge, and western edge, a plurality of grid elements, wherein a grid element is approximated by the local region of said shirt folding apparatus fully containing the nearest plate, whereby the collapsing of the shirt folding apparatus comprises the steps:

A) starting with the shirt folding apparatus open and flat;

B) folding the shirt folding apparatus about the center row or center column of said shirt folding apparatus in an accordion fold;

C) continuing the accordion folding process of said shirt folding apparatus until there is a single column or row of grid elements in line;

D) performing another accordion fold for the remaining three grid elements into a single stack of grid elements;

E) continuing the second accordion fold until said shirt folding apparatus is in its fully compacted form; and F) while holding the fully folded shirt folding apparatus, placing an open-ended cuff, wherein distally-located C-shaped ends of the cuff are placed around opposing ends of the compacted shirt folding apparatus, followed by moving a main body of the cuff to approximately a proximal lateral extent of the compacted shirt folding apparatus.

11. The method of collapsing a shirt folding apparatus into its most compact form according to claim 10, where instead of using said open-ended cuff to maintain the shirt folding apparatus in its most compact form, an alternative element comprising an elastic band, clip, or hook and loop fastener band is used.

* * * * *